US011480179B2

(12) United States Patent
Kim et al.

(10) Patent No.: US 11,480,179 B2
(45) Date of Patent: Oct. 25, 2022

(54) FLUID COMPRESSOR

(71) Applicant: LG Electronics Inc., Seoul (KR)

(72) Inventors: Jinho Kim, Seoul (KR); Sungyong Ahn, Seoul (KR); Jaeha Lee, Seoul (KR); Seheon Choi, Seoul (KR); Yoonsung Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 380 days.

(21) Appl. No.: 16/591,120

(22) Filed: Oct. 2, 2019

(65) Prior Publication Data

US 2020/0102955 A1 Apr. 2, 2020

(30) Foreign Application Priority Data

Oct. 2, 2018 (KR) ..... 10-2018-0117402

(51) Int. Cl.
*F01C 17/06* (2006.01)
*F04C 23/00* (2006.01)
*F04C 18/02* (2006.01)

(52) U.S. Cl.
CPC ..... *F04C 23/008* (2013.01); *F01C 17/066* (2013.01); *F04C 18/0215* (2013.01); *F04C 18/0223* (2013.01); *F04C 18/0253* (2013.01); *F04C 2270/72* (2013.01)

(58) Field of Classification Search
CPC ..... F04C 18/0253; F04C 2270/72; F04C 18/0215; F04C 18/0223; F04C 23/008; F04C 29/0057; F04C 29/0071; F04C 27/005; F04C 29/0021; F04C 29/02; F04C 2230/60; F04C 18/0269; F01C 17/066; F01C 21/007; F16D 3/04; F16D 1/108; F16D 1/112
USPC ..... 418/55.3, 55.1, 55.2, 55.5, 57; 464/102, 464/104
See application file for complete search history.

(56) References Cited

U.S. PATENT DOCUMENTS 4,795,323 A * 1/1989 Lessie ..... F01C 17/063 418/55.3
5,755,564 A * 5/1998 Machida ..... F01C 17/06 418/55.2
7,789,640 B2 * 9/2010 Uekawa ..... F01C 17/00 418/55.3
2016/0201678 A1 * 7/2016 Kouno ..... F04C 18/0261 418/55.2

FOREIGN PATENT DOCUMENTS

JP 03057892 A * 3/1991 ..... F01C 17/066
JP 05149264 6/1993
JP 08291794 A * 11/1996 ..... F04C 18/023
JP 10110690 4/1998
JP 11013656 1/1999

* cited by examiner

*Primary Examiner* — Devon C Kramer
*Assistant Examiner* — Wesley G Harris
(74) *Attorney, Agent, or Firm* — Fish & Richardson P.C.

(57) ABSTRACT

A fluid compressor includes a case, a fixed scroll, an orbiting scroll, a motor, and at least one anti-rotation unit. The case is configured to form an external appearance thereof. The fixed scroll is fixed in the case. The orbiting scroll is engaged with the fixed scroll at one side of the fixed scroll, and performs partitioning of a compression chamber. The motor provides the orbiting scroll with drive power. The anti-rotation unit is coupled to a side surface of the orbiting scroll so as to prevent rotation of the orbiting scroll.

20 Claims, 8 Drawing Sheets

FLUID COMPRESSOR

CROSS-REFERENCE TO RELATED APPLICATIONS

This application claims the benefit of Korean Patent Application No. 10-2018-0117402, filed on Oct. 2, 2018, which is hereby incorporated by reference as if fully set forth herein.

FIELD

The present disclosure relates to a fluid compressor, and more particularly to a fluid compressor for preventing vibration and noise generated in an anti-rotation unit designed to prevent rotation of an orbiting scroll.

BACKGROUND

A fluid compressor may include a fixed scroll and an orbiting scroll that form a compression chamber, and an anti-rotation unit preventing rotation of the orbiting scroll.

FIG. 1 is an exploded perspective view illustrating the principal components of a conventional fluid compressor.

Referring to FIG. 1, the conventional fluid compressor may include a main frame 1, a fixed scroll coupled to an upper side of the main frame 1, and an orbiting scroll 3 disposed between the main frame 1 and the fixed scroll 2 to form a the compression chamber by engaging with the fixed scroll 2.

For example, the orbiting scroll 3 may move or oscillate according to rotation of a rotary shaft (not shown) in a manner that fluid is compressed between the orbiting scroll 3 and the fixed scroll 2.

In this case, an Oldham ring 4 acting as an anti-rotation unit for preventing rotation of the orbiting scroll may be disposed between the main frame 1 and the orbiting scroll 3.

The Oldham ring 4 may include a first protrusion 5 protruding toward the orbiting scroll 3 and a second protrusion 7 protruding toward the main frame 1. A first groove 6 in which the first protrusion 5 is inserted may be formed at the bottom surface of the orbiting scroll 3, and a second groove 8 in which the second protrusion 7 is inserted may be formed at the top surface of the main frame 1.

The conventional fluid compressor has disadvantages in which much vibration and much noise are generated in the Oldham ring 4 during operation thereof.

In addition, as a bearing 9 provided in the orbiting scroll 3 gradually increases in size, the fluid compressor can more easily operate at a higher speed.

The conventional fluid compressor has disadvantages in that the diameter of the bearing provided to the orbiting scroll 3 is restricted due to the first groove 6.

Further, the fluid compressor provided with two compression chambers classified into an upper compression chamber provided at an upper part of the orbiting scroll and a lower compression chamber provided at a lower part of the orbiting scroll may have difficulty in arrangement of the Oldham ring. In order to arrange the Oldham ring in the fluid compressor, the fluid compressor has to secure an additional space corresponding to the length of the first groove 6 at the outside of the compression chamber.

SUMMARY

Accordingly, the present disclosure is directed to a fluid compressor that substantially obviates one or more problems due to limitations and disadvantages of the related art.

An object of the present disclosure is to provide a fluid compressor for preventing or reducing vibration and noise caused by an anti-rotation unit during operation of the fluid compressor.

Another object of the present disclosure is to provide a fluid compressor in which the diameter of a bearing provided to an orbiting scroll is restricted by the anti-rotation unit.

Another object of the present disclosure is to provide a compact fluid compressor provided with two compression chambers such that the anti-rotation unit can be easily disposed in the fluid compressor without using an additional space located outside the compression chambers.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a fluid compressor includes a case, a fixed scroll, an orbiting scroll, a motor, and at least one anti-rotation unit. The case is configured to form an external appearance thereof. The fixed scroll is fixed in the case. The orbiting scroll is engaged with the fixed scroll at one side of the fixed scroll, and performs partitioning of a compression chamber. The motor provides the orbiting scroll with drive power. The anti-rotation unit is coupled to a side surface of the orbiting scroll so as to prevent rotation of the orbiting scroll.

The fluid compressor may be formed in a longitudinal compact structure.

The anti-rotation unit may include a plate and a pin. The plate may be partially coupled to the fixed scroll in a manner that movement of the anti-rotation unit moving in the radial direction of the orbiting scroll is locked. The pin may protrude from the plate to the side surface of the orbiting scroll by a predetermined length.

A slide hole having a predetermined length may be formed at the side surface of the orbiting scroll in a manner that the pin is inserted into the slide hole.

In this case, the slide hole may be longer in length than the pin. Therefore, although the pin slidably moves in the slide hole, collision between the end of the pin and the inner end of the slide hole can be prevented.

The fixed scroll may include a first end plate and a first scroll protruding from one surface of the first end plate. The orbiting scroll may include a second end plate and a second scroll that protrudes from one surface of the second end plate while being engaged with the first scroll.

The slide hole may extend from a side circumferential surface of the second end plate to a radial inward direction of the second end plate.

The fluid compressor may further include a main frame that is fixed into the case and coupled to the fixed scroll. The orbiting scroll may be disposed between the fixed scroll and the main frame.

One part of the plate may be coupled to the fixed scroll, and the residual part of the plate may be coupled to the main frame.

A first reception part in which an upper part of the plate is inserted may be formed at a bottom surface of the fixed scroll. The main frame may include a second reception part in which a lower portion of the plate is inserted so that the second reception part is disposed to face the first reception part.

Each of the first reception part and the second reception part may extend to be longer than a width of the plate. The plate may be coupled to the first reception part and the second reception part in a manner that the plate slidably moves in an extension direction of the first reception part and the second reception part.

The main frame may include a reception space configured to accommodate the second end plate therein. The second reception part may be recessed in a radial outward direction of the main frame at an inner circumferential surface of the main frame by which the reception space is partitioned.

The first reception part may be recessed in a thickness direction of a first edge part of the fixed scroll coupled to a second edge part of the main frame.

The anti-rotation unit may be implemented as a plurality of anti-rotation units so that the plural anti-rotation units are spaced apart from each other at intervals of a predetermined distance in a circumferential direction of the orbiting scroll. The plurality of slide holes may be formed at the circumferential surface of the orbiting scroll so as to correspond to the anti-rotation unit.

The plurality of pins may protrude in a direction from the plate to a side surface of the orbiting scroll. The plurality of slide holes may be formed at the circumferential surface of the orbiting scroll so as to correspond to the plurality of pins.

The plate may be formed in a square or circular shape having a predetermined thickness. The pin may protrude from the plate in a perpendicular direction to the plate.

The pin may be formed in a cylindrical shape, and the slide hole may be formed in a cylindrical shape corresponding to the pin.

In one embodiment, the pin may include a decompression hole formed to extend over an entire length of the pin.

In another embodiment, a flat portion extending over at least a portion of a length of the pin may be formed at an outer circumferential surface of the pin.

When the orbiting scroll is driven by the motor, at least a portion of a circumferential surface of the pin may be maintained while in contact with at least a portion of an inner circumferential surface of the slide hole. Accordingly, vibration and noise generated between the anti-rotation unit and the orbiting scroll can be reduced.

The orbiting scroll and the pin may be formed of different materials. The orbiting scroll and the plate may be formed of the same material.

The orbiting scroll may be formed of aluminum (Al). The pin may be formed of a steel material having a greater strength than the aluminum (Al). Therefore, the fluid compressor may be designed to have a relatively light weight.

The fixed scroll may include a first fixed scroll provided with a first fixed wrap protruding in one direction, and a second fixed scroll that is provided with a second fixed wrap protruding in the other direction and is coupled to the fixed scroll.

The orbiting scroll may be disposed between the first fixed scroll and the second fixed scroll.

The orbiting scroll may include a first orbiting wrap that protrudes in one direction so as to be engaged with the first fixed wrap, and a second orbiting wrap that protrudes in the other direction so as to be engaged with the second fixed wrap.

A first reception groove having a predetermined length may be formed at one surface of the first fixed scroll in a manner that the plate is partially inserted into the first reception groove. A second reception groove having a predetermined length may be formed at the other surface of the second fixed scroll in a manner that some parts of a residual part of the plate are inserted into the second reception groove located to face the first reception groove.

The compression chamber may include a first compression chamber disposed between the first fixed scroll and the orbiting scroll, and a second compression chamber disposed between the second fixed scroll and the orbiting scroll.

It is to be understood that both the foregoing general description and the following detailed description of the present disclosure are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Figure 1:
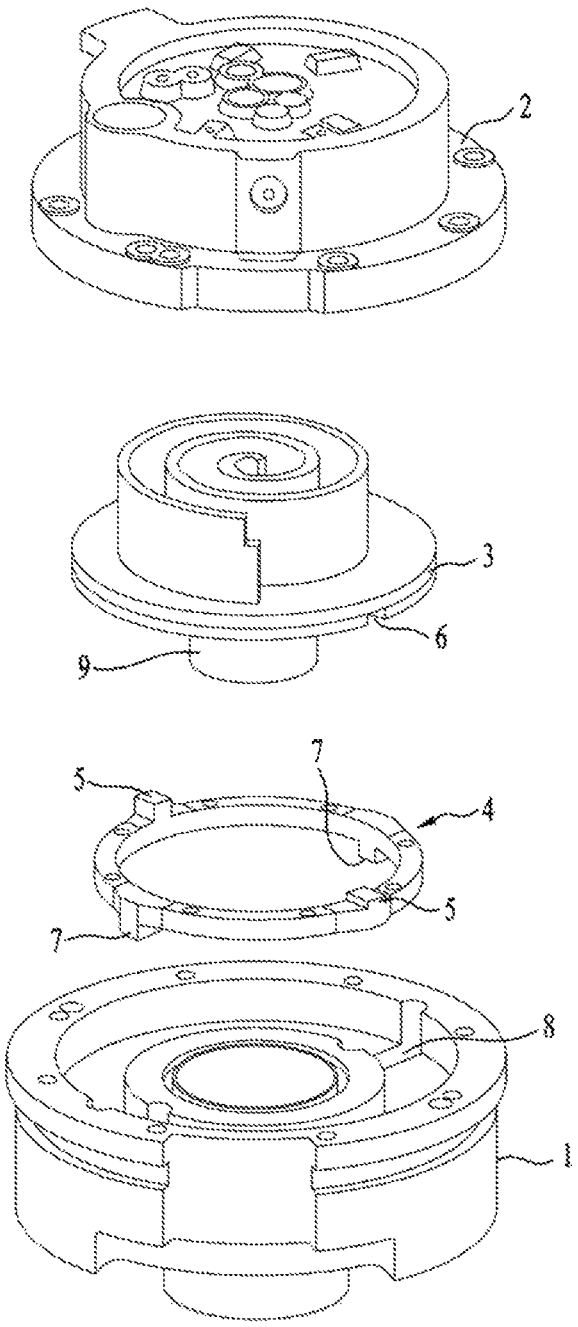
FIG. 1 is an exploded perspective view illustrating the principal components of a conventional fluid compressor.

Hereinafter, a rotary compressor according to the present disclosure will be described in detail with reference to the accompanying drawings. The accompanying drawings illustrate the exemplary embodiments of the present disclosure. The exemplary embodiments of the present disclosure are merely provided to describe the present disclosure in detail, and the technical range of the present disclosure is not limited by the exemplary embodiments.

In addition, the same reference numbers will be used throughout the drawings to refer to the same or like parts, and duplicate descriptions thereof will be omitted. In the drawings, the sizes, thicknesses, and shapes of constituent elements may be exaggerated or reduced for convenience of description.

In the following description, oscillation of the orbiting scroll may refer to a movement state in which the orbiting scroll revolves around the center of a rotary shaft. In this case, the center of the rotary shaft may be set to a radial center of a rotor constructing the motor.

Figure 2:
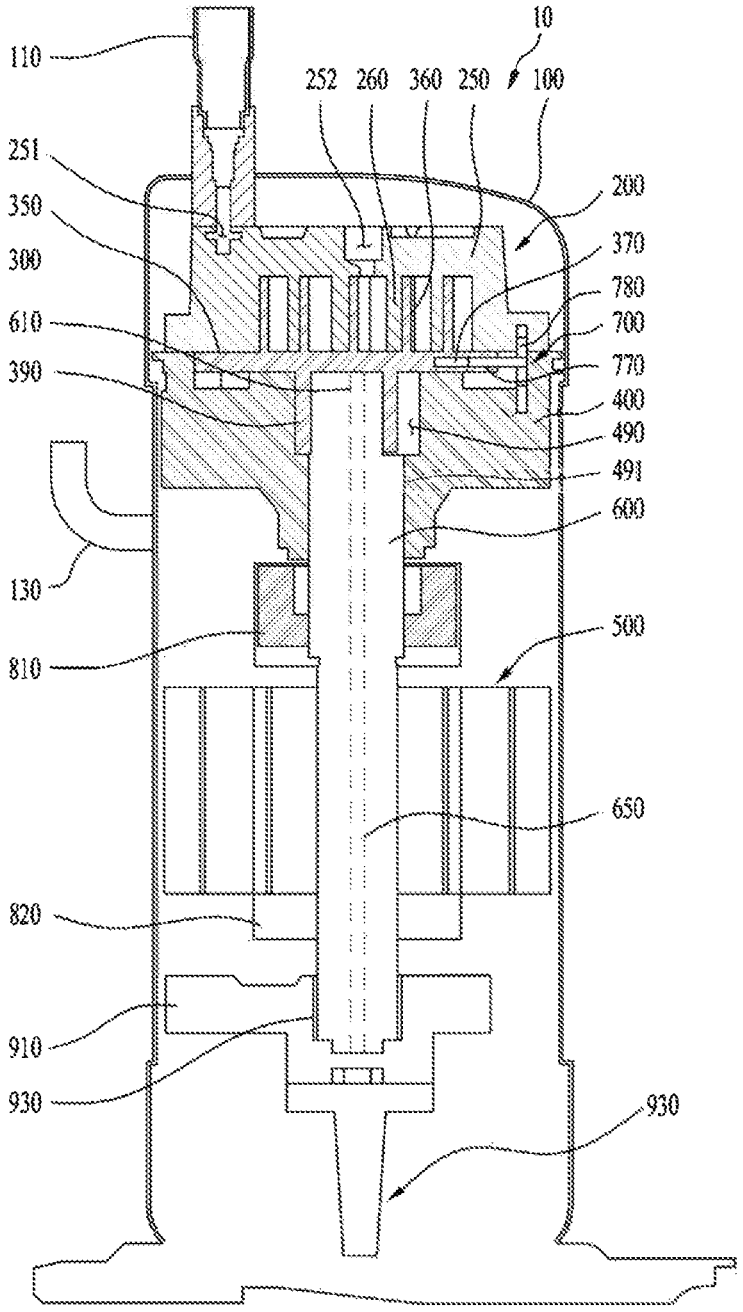
FIG. 2 is a cross-sectional view illustrating a fluid compressor according to a first embodiment of the present disclosure.
Figure 3A:
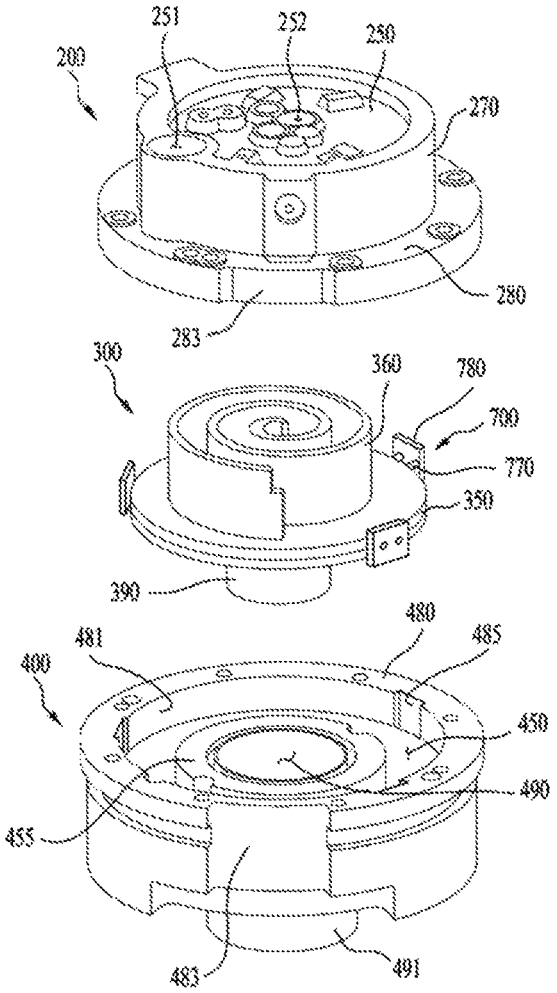
FIG. 3A is an exploded perspective view illustrating the principal components of the fluid compressor according to the first embodiment of the present disclosure.

FIG. 2 is a cross-sectional view illustrating a fluid compressor according to a first embodiment of the present disclosure. FIG. 3A is an exploded perspective view illustrating the principal components of the fluid compressor according to the first embodiment of the present disclosure, and FIG. 3B is a bottom view illustrating a fixed scroll of the fluid compressor according to the first embodiment of the present disclosure.

The overall structure of the fluid compressor according to the first embodiment of the present disclosure will hereinafter be described with reference to FIGS. 2 to 3B. Although there are no other descriptions, the fluid compressor according to the present disclosure may refer to a scroll compressor in which fluid is compressed by a fixed scroll and an orbiting scroll. In addition, the fluid may be a gaseous refrigerant.

Figure 3B:
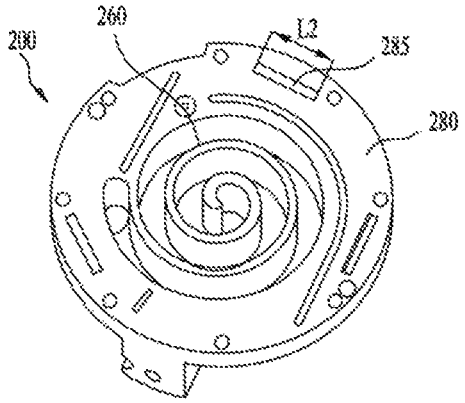
FIG. 3B is a bottom view illustrating a fixed scroll of the fluid compressor according to the first embodiment of the present disclosure.

Referring to FIGS. 2 to 3B, the fluid compressor according to the first embodiment of the present disclosure may be a so-called single fluid compressor provided with a single compression chamber.

The fluid compressor 10 according to the present disclosure may include a case 100 forming an external appearance thereof, a fixed scroll installed in the case 100, an orbiting scroll 300 engaged with the fixed scroll 200, a motor 500 to provide the orbiting scroll 300 with drive power, and at least one anti-rotation unit 700 to prevent rotation of the orbiting scroll 300.

The case 100 may include an inlet passage 110 through which fluid to be compressed is introduced, and an outlet passage 130 through which the compressed fluid is discharged. For example, the inlet passage 110 may be provided at a top surface of the case 100, and the outlet passage 130 may be provided at a side surface of the case 100.

The case 100 may be formed in a manner that the remaining parts other than the inlet passage 110 and the outlet passage 130 are sealed. Oil may be stored in a lower part of the case 100.

The fixed scroll 200 may include a first end plate 250 and a first scroll (also referred to as a first wrap) 260 protruding from one side of the first end plate 250. For example, the first scroll 260 may protrude downward from the first end plate 250.

The first end plate 250 may include an inlet 251 through which fluid to be compressed is introduced into a compression chamber, and an outlet 252 through which the compressed fluid is discharged from the compression chamber. The inlet 251 may communicate with the inlet passage 110. The fluid discharged through the outlet 252 may be discharged outside the case 100.

The first scroll 260 may be surrounded by a sidewall 270 extending from the first end plate 250.

The first end plate 250 may be provided at an upper end of the sidewall 270, and a first edge part 280 protruding radially outward from the fixed scroll 200 may be provided at a lower end of the sidewall 270. The first end plate 250, the sidewall 270, and the first edge part 280 may be integrated into one unit.

The first edge part 280 may be coupled to a main frame 400 to be described later. For example, the first edge part 280 may be coupled to the main frame 400 by a fastening member such as a bolt.

The first edge part 280 may include a first guide passage 283 recessed in a radial inward direction thereof. The first guide passage 283 may be formed to have a preset width in a circumferential direction of the first edge part 280. The fluid discharged to the first outlet 252 may flow into the outlet passage 130 through the first guide passage 283.

The orbiting scroll 300 may include a second end plate 350 and a second scroll (also referred to as a second wrap) 360 protruding from one side of the second end plate 350.

For example, the orbiting scroll 300 may be disposed below the fixed scroll 200. The second scroll 360 may protrude upward from the second end plate 350.

The compression chamber may be disposed between the fixed scroll 200 and the orbiting scroll 300. In more detail, the second scroll 360 may be engaged with the first scroll 260. The compression chamber may be disposed between the first scroll 260 and the second scroll 360.

The orbiting scroll 300 may include a bearing 390 coupled to a rotary shaft 600 to be described later. The bearing 390 may extend from the second end plate 350. In more detail, the bearing 390 may extend from the second end plate 350 in a direction opposite to the second scroll 360. In the illustrated embodiment, the bearing 390 may extend downward from the radial center point of the second end plate 350.

The motor 500 may be coupled to the rotary shaft 600 to rotate the rotary shaft 600, and the rotary shaft 600 may be coupled to the orbiting scroll 300.

Some parts of the rotary shaft 600 may include an eccentric part 610 in which a diameter thereof is formed to protrude to one side. The bearing 390 may be coupled to the eccentric part 610 while simultaneously receiving the eccentric part 610 therein. As a result, the rotary shaft 600 may enable the orbiting scroll 300 to resonate in the fixed scroll 200.

For example, the upper end of the rotary shaft 600 may be coupled to the bearing 390. In more detail, the eccentric part 610 may be provided at the upper end of the rotary shaft 600, and the eccentric part 610 may be coupled to the bearing 390.

The fluid compressor 10 may include the main frame 400 installed in the case 100. The main frame 400 may be fixed into the case 100, and the fixed scroll 200 may be coupled to the main frame 400. the orbiting scroll 300 may be disposed between the fixed scroll 200 and the main frame 400.

For example, the main frame 400 may include a second edge part 480 corresponding to the first edge part 280 of the fixed scroll 200. The fixed scroll 200 may be coupled to the main frame 400 through connection between the first edge part 280 and the second edge part 480.

The main frame 400 may include a bearing reception (or accommodation) part 490 in which the bearing 390 is rotatably installed. The bearing reception part 490 may be formed to have a diameter longer than the diameter of the bearing 390.

The main frame may include a reception space 450 (see FIGS. 3A and 3B) to accommodate the second end plate 360 therein. The reception space 450 may be provided at an upper side of the bearing reception part 490.

A ring-shaped support surface 455 supporting one side of the second end plate 360 may be provided at one end of the bearing reception part 490.

The main frame 400 may include a first support part 491 that is formed to enable the rotary shaft 600 to pass therethrough and to rotatably support some parts of the rotary shaft 600. The first support part 491 may be provided at a lower side of the bearing reception part 490.

A second guide passage 483 recessed in the radial inward direction may be provided at the outer circumferential surface of the main frame 400. The second guide passage 483 may be provided at a position corresponding to the first guide passage 283. In addition, the second guide passage 483 may be formed to have a predetermined width in the circumferential direction of the main frame 400. Fluid discharged to the first outlet 252 may sequentially pass through the first guide passage 283 and the second guide passage 483, and may thus flow into the outlet passage 130.

The rotary shaft 600 may be connected to the motor 500, and may rotate by the motor 500. A longitudinal central part of the rotary shaft 600 may be connected to the motor 500. For example, the motor 500 may include a stator and a rotor disposed at the radial central part of the stator. In addition, the longitudinal central part of the rotary shaft 600 may be coupled to the rotor.

In order to attenuate or reduce vibration caused by the eccentric part 610 of the rotary shaft 600, at least one balancer 810 and 820 may be coupled to the rotary shaft 600 or the motor 500. The at least one balancer 810 and 820 may be classified into a first balancer 810 and a second balancer 820. The first balancer 810 may be coupled to the rotary shaft 600 at one side of the motor 500, and the second balancer 820 may be coupled to the rotary shaft 600 at the other side of the motor 500.

The fluid compressor 10 may further include a sub frame 910 and an oil feeder 930. The sub frame 910 may be disposed at the other side of the motor 500, and the oil feeder 930 may be coupled to the sub frame 910 at the other side of the sub frame 910.

The sub frame 910 may be formed to rotatably support one end of the rotary shaft 600. For example, the sub frame 910 may include a lower support part 911 by which the lower end of the rotary shaft 600 is rotatably supported.

The oil feeder 930 may be formed to supply oil stored in the case 100 through the oil passage 650 formed in the rotary shaft 600. The oil passage 650 may extend from the radial central part of the rotary shaft 600 in the longitudinal direction of the rotary shaft 600.

Oil supplied through the oil feeder 830 may be guided to any of frictional surfaces (for example, a frictional surface between the rotary shaft 600 and the bearing 390, a frictional surface between the rotary shaft 600 and the first support part 490) through the oil passage 650.

The anti-rotation unit 700 may be formed to prevent rotation of the orbiting scroll 300. In order to prevent rotation of the orbiting scroll 300, at least one anti-rotation unit 700 may be coupled to a side surface of the orbiting scroll 300. In some examples, the anti-rotation unit 700 may include a pin assembly or a pin-plate assembly that includes a least one pin, or a plate and at least one pin attached to the plate.

Specifically, the anti-rotation unit 700 may include a plate 780 and at least one pin 770. The 770 may protrude from the plate 780 to the side surface of the orbiting scroll 300, or may protrude from the plate 780 to the rotary shaft 600.

The plate 780 may be formed in a square or circular shape, and may be formed to have a predetermined thickness. The plate 780 may be partially coupled to at least one of the fixed scroll 200 and the main frame 400. In the illustrated embodiment, the plate 780 may be partially coupled to the fixed scroll 200.

Specifically, the plate 780 may be partially coupled to the fixed scroll 200 or the main frame 400 in a manner that movement of the anti-rotation unit 700 moving in the radial direction of the orbiting scroll 300 can be locked. For example, since the plate 780 is partially coupled to the fixed scroll 200, movement of the anti-rotation unit 700 moving in the radial direction of the orbiting scroll 300 can be prevented.

The pin 770 may be coupled to the plate 780 or may be integrated with the plate 780. The pin 770 may extend to a predetermined length in a lateral direction of the orbiting scroll 300. The pin 770 may extend in a perpendicular direction to one surface of the plate 780. One surface of the plate 780 may be one side of the plate 780 facing the side surface of the orbiting scroll 300.

A slide hole 370 having a predetermined length may be formed at the side surface of the orbiting scroll 300 so that the pin 770 can be inserted into the slide hole 370. At least a part of the length of the pin 770 may be slidably inserted into the slide hole 370. The slide hole 370 may extend from the side surface of the orbiting scroll 300 to the radial central part of the orbiting scroll 300 by a predetermined length. The slide hole 370 may be longer in length than the pin 770. Therefore, collision between a free end of the pin 770 and an inner end of the slide hole 370 can be prevented.

In more detail, the slide hole 370 may be formed at the side surface of the second end plate 360. That is, the slide hole 370 may extend from the side circumferential direction of the second end plate 360 to the radial inward direction of the second end plate 360.

Therefore, unlike the conventional fluid compressor, the Oldham ring or the like need not be installed at the lower side of the orbiting scroll 300, such that the fluid compressor according to the present disclosure can be simplified in a compact structure.

Some parts of the plate 780 may be coupled to the fixed scroll 200, and the remaining parts of the plate 780 may be coupled to the main frame 400. In the illustrated embodiment, some parts of the plate 780 may be coupled to the fixed scroll 200, and the remaining parts of the plate 780 may be coupled to the main frame 400.

Specifically, a first reception part 285 in which some parts of the plate 780 are inserted may be formed at one surface of the fixed scroll 200, and a second reception part 485 in which the remaining parts of the plate 780 are inserted may be formed at the main frame 400.

Referring to FIG. 3B, the first reception part 285 may be formed at one surface of the first edge part 280 of the fixed scroll 200. The first reception part 285 may be recessed in a thickness direction of the first edge part 280. That is, the first reception part 285 may be recessed in the height direction of the fixed scroll 200.

In addition, the first reception part 285 may extend to a predetermined length. For example, the first reception part 285 may extend to be longer than the width of the plate 780. Therefore, during oscillation of the orbiting scroll 300, the plate 780 may slide in the longitudinal direction of the first reception part 285.

The first reception part 285 may extend parallel to a tangent line of the outer circumferential surface of the fixed scroll 200 corresponding to the longitudinal central part of the first reception part 285. That is, the first reception part 285 may extend parallel to the tangent line of a specific point corresponding to the longitudinal central point of the first reception part 285 at the outer circumferential surface of the fixed scroll 200.

The second reception part 485 may be disposed to correspond to the first reception part 285. That is, the second reception part 485 may be disposed to face the first reception part 285. The second reception part 485 may be identical in length to the first reception part 285. That is, the second reception part 485 may extend to have a length longer than the width of the plate 780.

As described above, the plate 780 may be coupled to the first reception part 285 and the second reception part 485 in a manner that the plate 780 slidably moves in the extension direction of the first reception part 285 and the second reception part 485.

The reception part 450 provided in the main frame 400 may be partitioned by the inner circumferential surface of the main frame 400. The second reception part 485 may be formed in the inner circumferential surface of the main frame 400. In more detail, the second reception part 485 may be recessed in the direction from the inner circumferential surface of the main frame 400 to the radial outward direction of the main frame 400.

The pin 770 may be formed in a cylindrical shape, and the slide hole 370 may be formed in a shape corresponding to the pin 770 in a manner that the pin 770 can be slidably inserted into the slide hole 370.

When the orbiting scroll 300 is driven by the motor 500, at least a portion of the circumferential surface of the pin 770 may be maintained while in contact with at least a portion of the inner circumferential surface of the slide hole 370. That is, during oscillation of the orbiting scroll 300, at least one of the shape and size of the pin 770 and the shape and size of the slide hole 370 may be decided in a manner that at least some parts of the circumferential surface of the pin 770 may be maintained while in contact with at least some parts of the inner circumferential surface of the slide hole 370.

Therefore, the orbiting scroll 300 and the anti-rotation unit 700 may move as a single mass, such that vibration and noise caused by the anti-rotation unit 700 can be reduced.

In order to minimize the weight of the fluid compressor 10, the orbiting scroll 300 may be formed of a lightweight metal material. In order to prevent seizure between the orbiting scroll 300 and the pin 770, the orbiting scroll 300 and the pin 770 may be formed of different materials. On the other hand, the plate 780 may not be in contact with the orbiting scroll 300, such that the orbiting scroll 300 and the plate 780 can be formed of the same material.

For example, in order to reduce the weight of the fluid compressor 10, the orbiting scroll 300 may be formed of aluminum (Al). In this case, the plate 780 may also be formed of aluminum (Al). Alternatively, the pin 770 may be formed of a material different from aluminum (Al). For example, the pin 770 may be formed of a steel material having a greater strength than aluminum (Al).

In order to distribute load caused by oscillation of the orbiting scroll 300, the plurality of anti-rotation units 700 may be spaced apart from each other at intervals of a predetermined angle in the circumferential direction of the orbiting scroll 300.

In this case, the slide hole 370 may be implemented as a plurality of slide holes 370, such that the plurality of slide holes 370 may be formed in the circumferential surface of the orbiting scroll 300 so as to correspond to the anti-rotation unit 700. That is, the slide holes 370 may be formed at the circumferential surface of the orbiting scroll 300 so as to correspond to the pin 770.

A method for enabling the orbiting scroll 300 engaged with the fixed scroll 200 to oscillate according to the present disclosure will hereinafter be described with reference to the attached drawings.

Figure 4A:
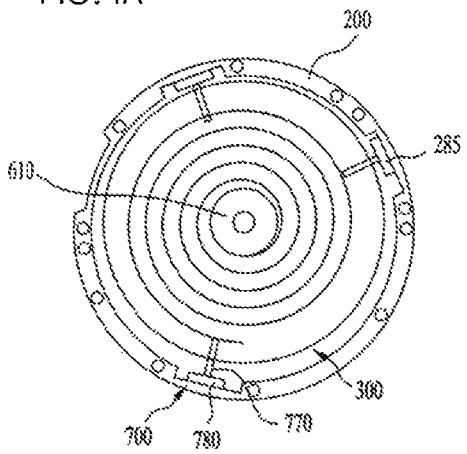
FIGS. 4A to 4C are views sequentially illustrating oscillation states of an orbiting scroll engaged with the fixed scroll according to the present disclosure.
Figure 4B:
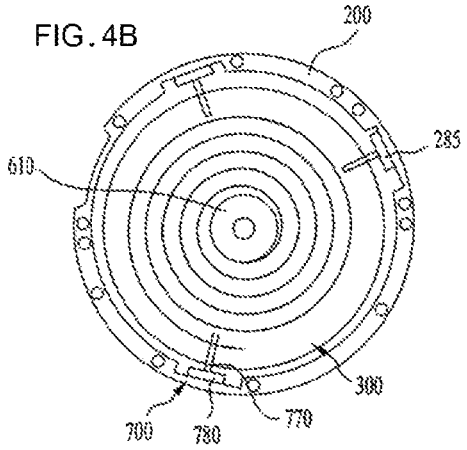
Figure 4C:
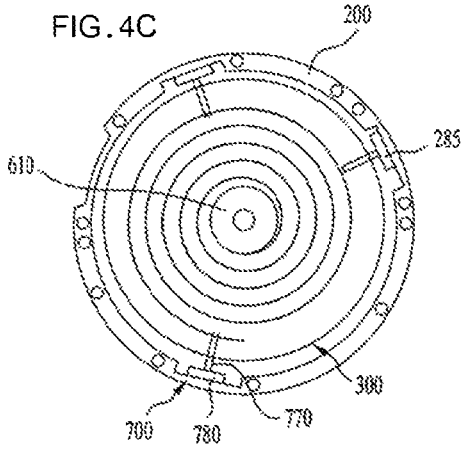

FIGS. 4A to 4C are views sequentially illustrating oscillation states of the orbiting scroll engaged with the fixed scroll according to the present disclosure.

Since the orbiting scroll 300 is connected to the eccentric part 610 of the rotary shaft as shown in FIGS. 4A to 4C, the orbiting scroll 300 engaged with the fixed scroll 200 may oscillate during rotation of the rotary shaft.

In order to prevent rotation of the orbiting scroll 300 during oscillation of the orbiting scroll 300, the plurality of anti-rotation units 700 may be coupled to the side surface of the orbiting scroll 300.

In order to restrict (or lock) radial movement of the anti-rotation units 700, each of the anti-rotation units 700 may include the plate 780 connected to the first reception part 285 formed in the fixed scroll 200.

In addition, each of the anti-rotation units 700 may include the pin 770 formed to extend from the plate 780 to the side surface of the orbiting scroll 300.

The pins 700 respectively included in the anti-rotation units 700 may sequentially slide through holes formed in the orbiting scroll 300, such that the orbiting scroll 300 can oscillate while being engaged with the fixed scroll 200.

Various embodiments related to arrangement of at least one anti-rotation unit 700 will hereinafter be described with reference to the attached drawings.

Figure 5A:
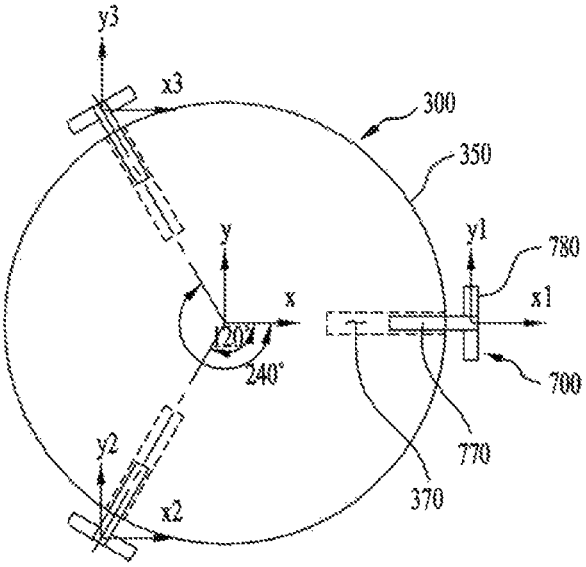
FIG. 5A is a layout diagram illustrating one example of an anti-rotation unit coupled to the orbiting scroll.
Figure 5B:
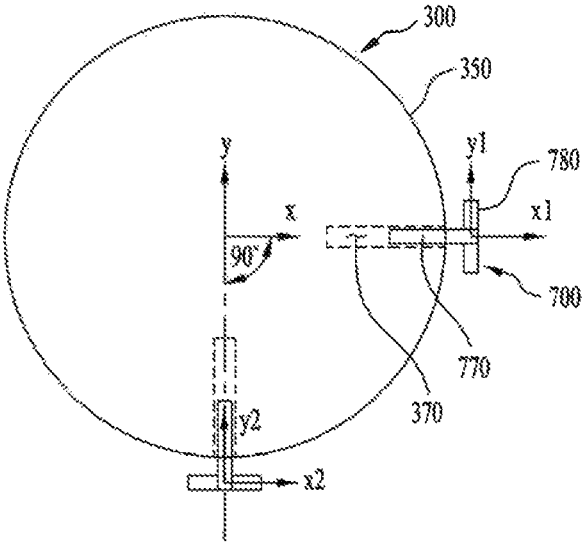
FIG. 5B is a layout diagram illustrating another example of an anti-rotation unit coupled to the orbiting scroll.

FIG. 5A is a layout diagram illustrating one example of the anti-rotation unit coupled to the orbiting scroll, and FIG. 5B is a layout diagram illustrating another example of the anti-rotation unit coupled to the orbiting scroll.

The plural anti-rotation units 700 may be spaced apart from each other at intervals of a predetermined distance (e.g., the distance corresponding to a predetermined angle) at the circumferential surface of the orbiting scroll 300.

Referring to FIG. 5A, three anti-rotation units 700 may be spaced apart from each other at intervals of a predetermined distance corresponding to an angle of 120° in the circumferential direction of the orbiting scroll 300. Therefore, when the orbiting scroll 300 is driven, load applied to the anti-rotation units 700 can be distributed to the three anti-rotation units 700.

Referring to FIG. 5B, two anti-rotation units 700 may be spaced apart from each other at intervals of a predetermined distance corresponding to 90° in the circumferential direction of the orbiting scroll 300. Accordingly, load applied to the anti-rotation units 700 may be distributed to two anti-rotation units 700 by operation of the orbiting scroll.

Other embodiments related to the anti-rotation unit 700 will hereinafter be described with reference to the attached drawings.

Figure 6A:
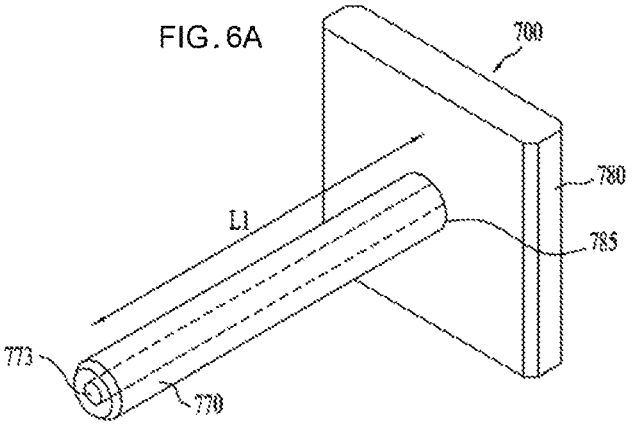
FIG. 6A is a view illustrating an anti-rotation unit according to one embodiment of the present disclosure.
Figure 6B:
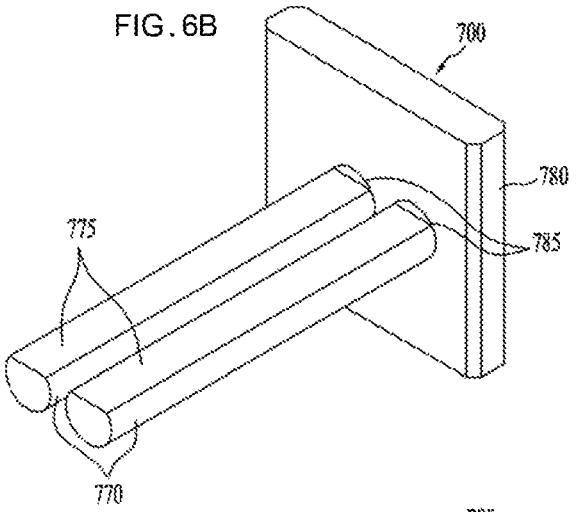
FIG. 6B is a view illustrating an anti-rotation unit according to another embodiment of the present disclosure.
Figure 6C:
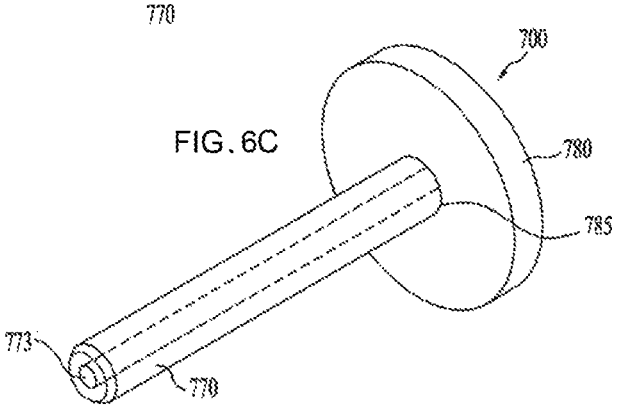
FIG. 6C is a view illustrating an anti-rotation unit according to still another embodiment of the present disclosure.

FIG. 6A is a view illustrating the anti-rotation unit according to one embodiment of the present disclosure, FIG. 6B is a view illustrating the anti-rotation unit according to another embodiment of the present disclosure, and FIG. 6C is a view illustrating the anti-rotation unit according to still another embodiment of the present disclosure.

Referring to FIG. 6A, the anti-rotation unit 700 may include a plate 780 and a single pin 770. The plate 780 may be formed in a square shape, and may be formed to have a predetermined thickness. The pin 770 may extend in a vertical direction from the plate 780. In this case, it is obvious to those skilled in the art that the slide hole 370 corresponding to the pin 770 may also be formed in the above-mentioned orbiting scroll.

The pin 770 may be formed in a cylindrical shape, and the slide hole 370 may also be formed in a cylindrical shape corresponding to the pin 770.

The pin 770 may be connected to a coupling hole 785 formed in the center part of the plate 780.

In the situation in which the pin 770 slides into the slide hole 370 formed in the orbiting scroll, when pressure between the front end of the pin 770 and the inner end of the slide hole 370 increases, the pin 770 may smoothly and slidably move in the slide hole 370.

Therefore, in order to reduce pressure in the slide hole 370, a decompression hole 773 may be formed in the pin 770. The decompression hole 773 may be formed at the radial central part of the pin 770, and may extend over the entire length of the pin 770.

Referring to FIG. 6B, the anti-rotation unit 700 may include a plate 780 and one pair of pins 770. Here, the plate 780 may be formed in a square shape, and may have a predetermined thickness. The pair of the pins 770 may extend perpendicular to the plate 780. In this case, it is obvious to those skilled in the art that the slide holes 370 corresponding to one pair of pins 770 may also be formed in the orbiting scroll.

In addition, one pair of coupling holes 785 to be coupled to one pair of pins 770 may also be formed in the plate 780.

Each pin 770 may be formed in a cylindrical shape as a whole. In this case, in order to reduce pressure in the slide hole 370, a flat portion 775 extending over at least a portion of the length of the pin 770 may be formed at the outer circumferential surface of each pin 770.

For example, a rear end of the pin 770 may be coupled to the coupling hole 785 formed in the plate 780. The flat portion 775 may extend in the longitudinal direction of the pin 770 while excluding the rear end of the pin 770.

It is obvious to those skilled in the art that the decompression hole 773 shown in FIG. 6A instead of the flat portion 775 can also be applied to the present disclosure. In addition, it is also obvious to those skilled in the art that the flat portion 775 instead of the decompression hole 773 can also be applied to the embodiment of FIG. 6A.

Referring to FIG. 6C, the anti-rotation unit 700 may include a plate 780 and one pair of pins 770. Here, the plate 780 may be formed in a circular shape, and may have a predetermined thickness. Each pin 770 may extend perpendicular to the plate 780.

In the illustrated embodiment, although the decompression hole 773 is formed in the longitudinal direction of the pin 770, it should be noted that the flat portion 775 shown in FIG. 6B instead of the decompression hole 773 can also be applied to the pin 770.

In accordance with the present embodiment, since the plate 780 is formed in a cylindrical shape, the plate 780 can be rotated and slidably moved in the extension direction of the first reception part and the second reception part. In other words, according to the present embodiment, frictional force between the plate 780 and each of the first and second reception parts can be reduced.

A fluid compressor according to a second embodiment of the present disclosure will hereinafter be described with reference to the attached drawings.

Figure 7:
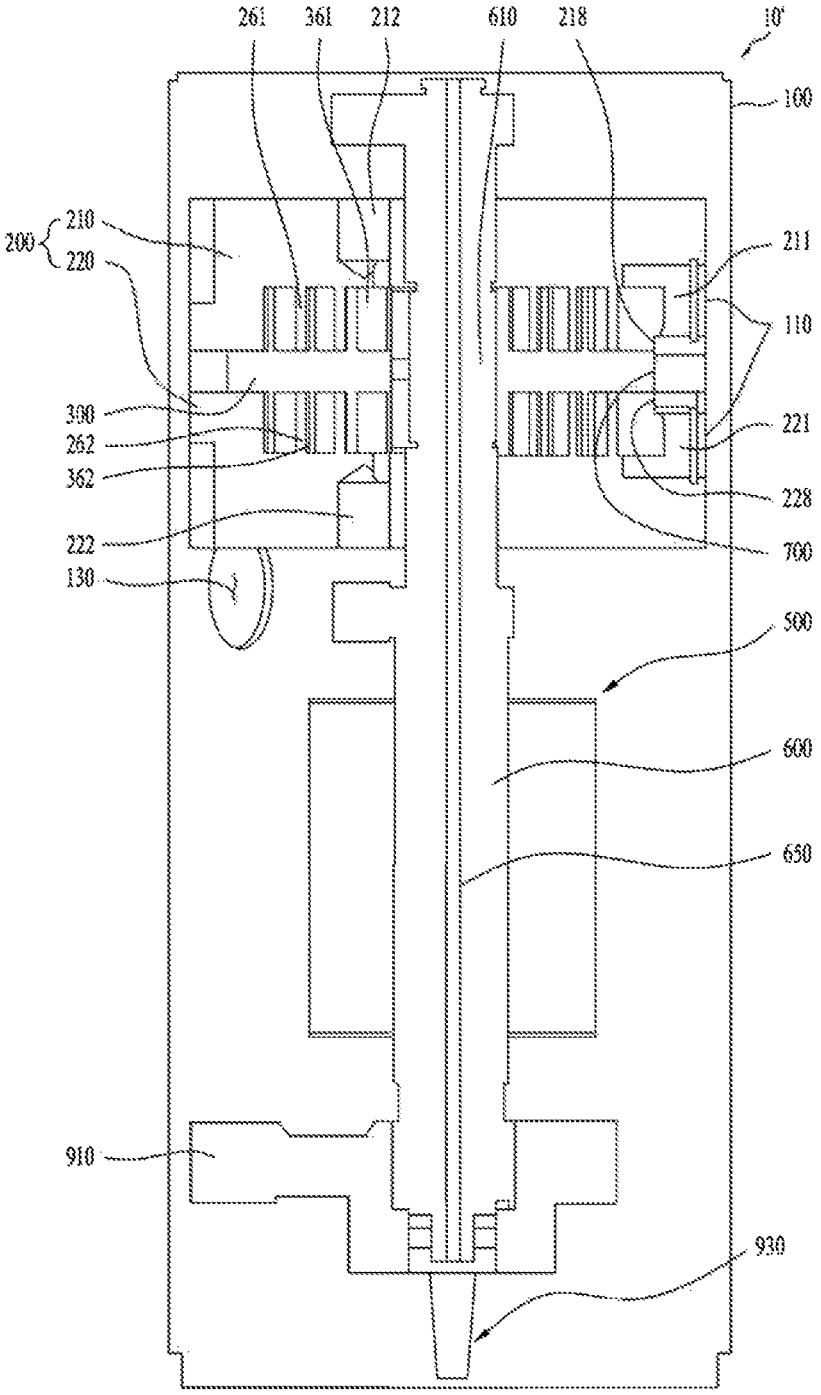
FIG. 7 is a cross-sectional view illustrating a fluid compressor according to a second embodiment of the present disclosure.
Figure 8:
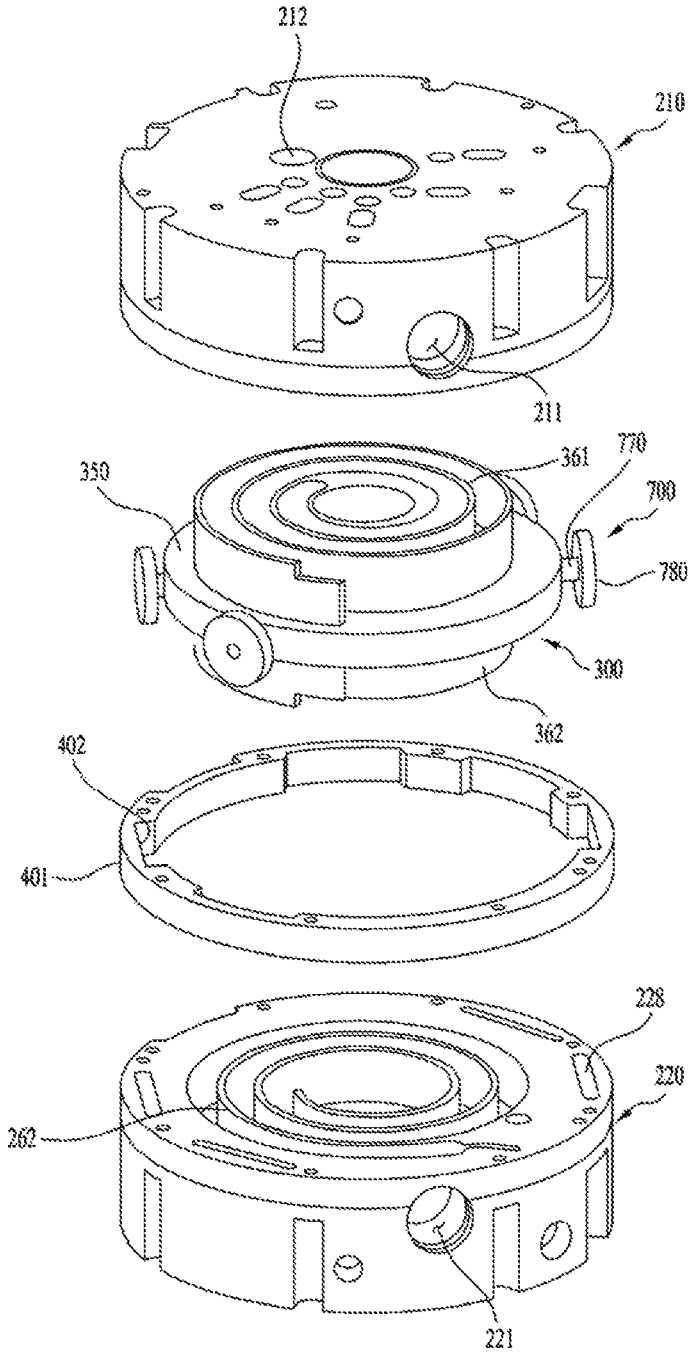
FIG. 8 is an exploded perspective view illustrating the principal components of the fluid compressor according to a second embodiment of the present disclosure.

FIG. 7 is a cross-sectional view illustrating the fluid compressor according to the second embodiment of the present disclosure. FIG. 8 is an exploded perspective view illustrating the principal components of the fluid compressor according to the second embodiment of the present disclosure.

The overall structure of the fluid compressor 10' according to the second embodiment of the present disclosure will hereinafter be described with reference to FIGS. 7 and 8. The fluid compressor 10' according to the second embodiment may be a so-called double fluid compressor provided with two compression chambers.

For convenience of description and better understanding of the present disclosure, the fluid compressor 10' according to the second embodiment will hereinafter be described centering upon a difference between the first embodiment and the second embodiment.

The fluid compressor 10' according to the second embodiment may include a sealed case 100, and the case 100 may include an inlet passage 110 and an outlet passage 130. The inlet passage 110 and the outlet passage 130 may be formed at the side surface of the case 100.

A lower end of the rotary shaft 600 may be supported by the sub frame 910, and the oil feeder 930 may be coupled to a lower end of the sub frame 910. Oil supplied through the oil feeder 930 may be guided to a frictional surface (such as a bearing) through the oil passage 650 formed in the rotary shaft 600.

The fixed scroll 200 may include a first fixed scroll 210 and a second fixed scroll 220. The second fixed scroll 220 may be coupled to the first fixed scroll 210 at one side of the first fixed scroll 210.

The first fixed scroll 210 may include a first fixed wrap 261 protruding in one direction, and the second fixed scroll 220 may include a second fixed wrap 262 protruding upward.

The orbiting scroll 300 may be disposed between the first fixed scroll 210 and the second fixed scroll 220. The orbiting scroll 300 may include a first orbiting wrap 361 protruding in one direction and a second orbiting wrap 362 protruding in the other direction. The first orbiting wrap 361 may protrude in one direction from the second end plate 350 of the orbiting scroll 300, or may protrude upward from the second end plate 350 of the orbiting scroll 300. In addition, the second orbiting wrap 362 may protrude downward from the second end plate 350, or may protrude in the other direction from the second end plate 350.

The first orbiting wrap 361 may be engaged with the first fixed wrap 261, and the second orbiting wrap 362 may be engaged with the second fixed wrap 262. In the present embodiment, the compression chamber in which fluid is compressed may include a first compression chamber (hereinafter referred to as an upper compression chamber) and a second compression chamber (hereinafter referred to as a lower compression chamber). The first compression chamber may be partitioned by the second orbiting wrap 361 and the first fixed wrap 261. The second compression chamber may be partitioned by the second orbiting wrap 362 and the second fixed wrap 262.

An upper inlet 211 communicating with the upper compression chamber and a first outlet 212 through which fluid compressed by the upper compression chamber is discharged may be formed in the first fixed scroll 210. The first inlet 211 may be formed to communicate with the inlet passage 110 of the case 100.

A second inlet 221 communicating with the lower compression chamber and a second outlet 222 through which fluid compressed by the lower compression chamber is discharged may be formed in the second fixed scroll 220. The second inlet 221 may communicate with the inlet passage 110 of the case 100.

Fluid discharged through the first outlet 212 and the second outlet 222 may be guided to the outlet passage 130 of the case 100.

In accordance with the present embodiment, the rotary shaft 600 may be formed to pass through both the fixed scroll 200 and the orbiting scroll 300. Specifically, the orbiting scroll 300 may be coupled to the eccentric part 610 of the rotary shaft 600.

In addition, the fluid compressor 10' according to the present embodiment may further include a fastening ring 401 disposed between the first fixed scroll 210 and the second fixed scroll 220. The first fixed scroll 210 and the second fixed scroll 220 may be interconnected through the fastening ring 401.

In addition, the fastening ring 401 disposed between the first fixed scroll 210 and the second fixed scroll 220 may perform partitioning of the space for receiving the second end plate 350 of the orbiting scroll 300.

The fastening ring 401 may include a concave portion 402 formed at a specific position corresponding to the plate 780 to be described later. Here, the concave portion 402 may be recessed in the radial outward direction. By the concave portion 402, the fastening ring 401 may include the space in which the plate 780 is disposed.

In the present embodiment, in order to prevent rotation of the orbiting scroll 300, at least one anti-rotation unit 700 may be slidably coupled to the side surface of the orbiting scroll 300. The pin 770 of the anti-rotation unit 700 can be also coupled to the slide hole formed in the orbiting scroll 300 in the same manner as in the second embodiment, and as such a detailed description thereof will herein be omitted for convenience of description.

The plate 780 of the anti-rotation unit 700 may be coupled to the first fixed scroll 210 and the second fixed scroll 220.

A first reception groove 218 having a predetermined length in which some parts of the plate 780 are inserted into one side of the first fixed scroll 210. In addition, a second reception groove 228 having a predetermined length in which some parts of the remaining parts of the plate 780 are inserted into one side of the second fixed scroll 220.

The second reception groove 228 may be disposed and formed to correspond to the first reception groove 218. In addition, the concave portion 402 of the fastening ring 401 may be arranged at a position corresponding to the first reception groove 218 and the second reception groove 228.

The plate 780 may be rotatably or slidably moved in the extension direction of the first reception groove 218 and the second reception groove 228.

In the present embodiment, the plural anti-rotation units 700 may be spaced apart from each other at intervals of a predetermined distance in the circumferential direction of the orbiting scroll 300. The number of the first reception grooves 218 and the number of the second reception grooves 228 may be identical to the number of anti-rotation units 700.

In order to apply the Oldham ring to the double fluid compressor shown in the second embodiment, there is a need for the Oldham ring to be arranged in the radial outward direction of the fixed scroll of the fluid compressor. As a result, the diameter of the fluid compressor may unavoidably increase.

Since the anti-rotation unit is coupled to the circumference of the orbiting scroll as described above, the diameter of the fluid compressor can be prevented from increasing, and at the same time the diameter of the bearing supporting the rotary shaft can be increased. In addition, the present disclosure can prevent or reduce vibration or noise caused by the anti-rotation unit during operation of the fluid compressor.

As is apparent from the above description, the fluid compressor according to the embodiments of the present disclosure can prevent or reduce vibration and noise caused by the anti-rotation unit during operation of the fluid compressor.

The fluid compressor according to the embodiments of the present disclosure may enable the diameter of the bearing provided to the orbiting scroll not to be restricted by the anti-rotation unit.

Even when two compression chambers are provided to the fluid compressor, the fluid compressor can be simplified in structure such that the anti-rotation unit can be easily disposed in the fluid compressor without using a separate additional space.

It will be apparent to those skilled in the art that various modifications and variations can be made in the present disclosure without departing from the spirit or scope of the inventions. Thus, it is intended that the present disclosure covers the modifications and variations of this invention provided they come within the scope of the appended claims and their equivalents.

What is claimed is:

1. A fluid compressor comprising:

a case that defines an external appearance of the fluid compressor;

a fixed scroll disposed in the case and fixed to the case;

an orbiting scroll that is disposed at one side of the fixed scroll, that is engaged with the fixed scroll, and that defines a compression chamber with the fixed scroll;

a motor configured to rotate a rotating shaft for transmitting power to the orbiting scroll; and at least one anti-rotation unit movably coupled to a circumferential side surface of the orbiting scroll and configured to limit rotation of the orbiting scroll, the at least one anti-rotation unit comprising:

a plate, a first portion of the plate being disposed at the fixed scroll, and at least one pin that extends from the plate to the orbiting scroll and is configured to insert into the circumferential side surface of the orbiting scroll in a direction toward an axis of the rotating shaft, wherein the fixed scroll defines a first recess that receives the first portion of the plate, and wherein the orbiting scroll defines at least one slide hole that is depressed from the circumferential side surface of the orbiting scroll toward the axis of the rotating shaft and configured to receive the at least one pin toward the axis of the rotating shaft-.

2. The fluid compressor according to claim 1, wherein the at least one slide hole extends inward along a radial direction of the orbiting scroll, and wherein a radial length of the at least one slide hole is longer than a length of the at least one pin from the plate in the radial direction.

3. The fluid compressor according to claim 1, wherein the fixed scroll comprises a first end plate and a first scroll that protrudes from the first end plate, wherein the orbiting scroll comprises a second end plate and a second scroll that protrudes the second end plate and that is engaged with the first scroll, and wherein the at least one slide hole extends inward from a side circumferential surface of the second end plate along a radial direction of the orbiting scroll.

4. The fluid compressor according to claim 3, further comprising:

a main frame disposed in the case and fixed to the case, the main frame being coupled to the fixed scroll, wherein the orbiting scroll is disposed between the fixed scroll and the main frame, and wherein a second portion of the plate is disposed at the main frame.

5. The fluid compressor according to claim 4, wherein the main frame defines a second recess that faces the first recess and that receives the second portion of the plate.

6. The fluid compressor according to claim 5, wherein each of the first recess and the second recess extends along a tangential direction of the fixed scroll, wherein a width of the first recess and the second recess is greater than a width of the plate, and wherein the plate is configured to slidably move along the tangential direction in the first recess and the second recess.

7. The fluid compressor according to claim 5, wherein the main frame defines a reception space that accommodates the second end plate therein, and wherein the second recess is recessed radially outward from an inner circumferential surface of the main frame that faces the reception space.

8. The fluid compressor according to claim 5, wherein the fixed scroll has a first edge part that faces and is coupled to the main frame, and wherein the first recess is recessed from the first edge part in a direction away from the main frame.

9. The fluid compressor according to claim 1, wherein the least one anti-rotation unit comprises a plurality of anti-rotation units that are spaced apart from one another by a predetermined distance and that are arranged along a circumferential direction of the orbiting scroll, and wherein the at least one slide hole comprises a plurality of slide holes that are defined at the circumferential side surface of the orbiting scroll, each of the plurality of slide hole being configured to receive one of the plurality of anti-rotation units.

10. The fluid compressor according to claim 9, wherein the at least one pin comprises a plurality of pins that protrude from the plate to the circumferential side surface of the orbiting scroll, and wherein each of the plurality of slide holes is configured to receive one of the plurality of pins.

11. The fluid compressor according to claim 1, wherein the plate has a square shape or a circular shape, and the at least one pin protrudes from the plate in a direction orthogonal to the plate.

12. The fluid compressor according to claim 1, wherein the at least one pin defines a decompression hole therein that extends through the at least one pin from the plate to a distal end of the at least one pin facing the orbiting scroll.

13. The fluid compressor according to claim 1, wherein the at least one pin comprises:

a cylindrical portion, the at least one slide hole having a cylindrical shape corresponding to the cylindrical portion; and a flat portion that is disposed at an outer surface of the at least one pin and that extends through at least a portion of the at least one pin along a length direction from the plate to the orbiting scroll.

14. The fluid compressor according to claim 1, wherein the at least one pin is configured to, based on the orbiting scroll being driven by the motor, maintain contact between at least a portion of an outer circumferential surface of the at least one pin and at least a portion of an inner circumferential surface of the at least one slide hole.

15. The fluid compressor according to claim 1, wherein the orbiting scroll and the plate are made of a first material, and the at least one pin is made of a second material different from the first material.

16. The fluid compressor according to claim 15, wherein the orbiting scroll is made of aluminum, and the at least one pin is made of a steel material.

17. The fluid compressor according to claim 1, wherein the fixed scroll comprises:

a first fixed scroll comprising a first fixed wrap that protrudes in a first direction, and a second fixed scroll that is coupled to the first fixed scroll and that comprises a second fixed wrap that protrudes in a second direction opposite to the first direction, wherein the orbiting scroll is disposed between the first fixed scroll and the second fixed scroll, and wherein the orbiting scroll comprises:

a first orbiting wrap that protrudes in the second direction and that is engaged with the first fixed wrap, and a second orbiting wrap that protrudes in the first direction and that is engaged with the second fixed wrap.

18. The fluid compressor according to claim 17, wherein the first fixed scroll defines a first reception groove that receives a part of the plate, and wherein the second fixed scroll defines a second reception groove that faces the first reception groove and that receives another part of the plate disposed outside the first reception groove.

19. The fluid compressor according to claim 17, wherein the compression chamber comprises:

a first compression chamber defined between the first fixed wrap and the first orbiting wrap; and a second compression chamber defined between the second fixed wrap and the second orbiting wrap.

20. The fluid compressor according to claim 1, wherein the axis of the rotating shaft is perpendicular to the one side of the fixed scroll and extends through the fixed scroll and the orbiting scroll.

* * * * *